US008556000B2

(12) United States Patent
Desmette et al.

(10) Patent No.: US 8,556,000 B2
(45) Date of Patent: Oct. 15, 2013

(54) DEVICE FOR MONITORING A DRILLING OR CORING OPERATION AND INSTALLATION COMPRISING SUCH A DEVICE

(75) Inventors: Sebastian Desmette, Thieusies (BE); Thomas Richard, Kensington (AU); Abdelhakim Hahati, Molenbeek St. Jean (BE)

(73) Assignee: Lynx Drilling Tools Limited, Aberdeen (GB)

( * ) Notice: Subject to any disclaimer, the term of this patent is extended or adjusted under 35 U.S.C. 154(b) by 664 days.

(21) Appl. No.: 11/884,723

(22) PCT Filed: Feb. 21, 2006

(86) PCT No.: PCT/EP2006/001674

§ 371 (c)(1),
(2), (4) Date: Sep. 6, 2007

(87) PCT Pub. No.: WO2006/087239

PCT Pub. Date: Aug. 24, 2006

(65) Prior Publication Data

US 2008/0251292 A1 Oct. 16, 2008

(30) Foreign Application Priority Data

Feb. 21, 2005 (BE) ..... 2005/0091

(51) Int. Cl.
*E21B 47/02* (2006.01)
*E21B 47/01* (2012.01)

(52) U.S. Cl.
USPC ..... 175/45; 175/40; 166/64; 166/66; 73/152.01

(58) Field of Classification Search
USPC ..... 175/40, 45; 166/64, 66; 73/152.01, 73/152.57, 152.59, 152.45
See application file for complete search history.

(56) References Cited

U.S. PATENT DOCUMENTS 2,411,696 A * 11/1946 Silverman et al. ..... 340/853.7
2,466,034 A 4/1949 Mathews
4,041,780 A 8/1977 Angehrn
4,303,994 A 12/1981 Tanguy (Continued)

FOREIGN PATENT DOCUMENTS

EP 0377235 7/1990
GB 2247477 3/1992

(Continued)

OTHER PUBLICATIONS

A. A. Mo Л ЛЧ ahob; Textbook published in Moscow by He Д pa 1983; pp. 64-65, 106-107, and 172-183.

*Primary Examiner* — David Bagnell
*Assistant Examiner* — James Sayre
(74) *Attorney, Agent, or Firm* — James Creighton Wray

(57) ABSTRACT

Device comprising equipment for measuring parameters of a drilling or coring operation by means of a drillbit fixed to the end of a drill string, measurement equipment (7) being housed in a chamber (5) made in a coupling (1, 18) that is designed to be interposed between two drill string pipes or between the drillbit and a drill string pipe, or to constitute an adapter (18) for a cutting head (15) of the drillbit of a drill string.

46 Claims, 6 Drawing Sheets

(56) References Cited

U.S. PATENT DOCUMENTS

| | | | | |
|---|---|---|---|---|
| 4,739,325 | A * | 4/1988 | MacLeod | 340/854.4 |
| 4,811,597 | A | 3/1989 | Hebel | |
| 5,216,242 | A * | 6/1993 | Perry et al. | 250/269.1 |
| 5,347,850 | A | 9/1994 | Henneuse | |
| 5,347,859 | A * | 9/1994 | Henneuse et al. | 73/152.48 |
| 5,439,064 | A | 8/1995 | Patton | |
| 5,602,541 | A * | 2/1997 | Comeau et al. | 340/853.3 |
| 6,691,802 | B2 * | 2/2004 | Schultz et al. | 175/56 |
| 6,692,802 | B1 * | 2/2004 | Nava | 428/35.7 |
| 6,915,686 | B2 * | 7/2005 | Baustad | 73/152.46 |
| 2003/0131992 | A1 * | 7/2003 | Michael et al. | 166/255.2 |
| 2004/0251048 | A1 * | 12/2004 | Kurkoski | 175/41 |

FOREIGN PATENT DOCUMENTS

| | | | |
|---|---|---|---|
| GB | 2275283 | | 8/1994 |
| GB | 2244127 | A * | 5/2000 |
| RU | 2143557 | | 12/1999 |
| RU | 2229012 | | 5/2004 |

* cited by examiner

DEVICE FOR MONITORING A DRILLING OR CORING OPERATION AND INSTALLATION COMPRISING SUCH A DEVICE

This application claims the benefit of Belgian Application No. 2005/0091 filed Feb. 21, 2005 and PCT/EP2006/001674 filed Feb. 21, 2006, which are hereby incorporated by reference in their entirety.

FIELD OF THE INVENTION

The invention relates to installations for drilling or coring, especially for drilling oil wells.

The invention relates more particularly to a device intended to be attached to a drilling or coring installation, in order to monitor it, by measuring downhole parameters.

PRIOR ART

Well drilling and coring are normally carried out by means of a drillbit that is connected to a drive motor, located on the surface, by means of a drill string. As the drillbit progresses into the hole, drill pipes are added to the drill string.

It is desirable to have the maximum amount of information regarding the drilling or coring operations, especially as regards the medium being drilled and the behaviour of the drillbit and of its cutting head. Information regarding the medium being drilled includes in particular the type of rock formation attacked, the composition of the drilling mud, the presence of oil or other fluids. Information relating to the drillbit and its cutting heat include its instantaneous rotation speed, the variations in rotation speed, the position of the cutting head relative to the wall of the hole drilled, the variations in the rotation speed and in the rate of advance in the hole, the lateral and axial impacts suffered by the drillbit, and the whirling of the drillbit.

This drilling information or these drilling parameters may be stored during the drilling or coring operation and adaptersequently used for analysing problems that might arise during the drilling or coring operation (such as, for example, a momentary and unplanned slow-down in the rate of penetration of the cutting head into the rock formation or an abnormally rapid wear of the cutting head) or for adapting the conditions of other drilling or coring operations.

To detect the abovementioned information or parameters, drilling installations are provided with appropriate measurement equipment, this being placed in the drill string or in the drilling head.

Thus, document BE-1 007 274 describes a drillbit whose cutting head contains accelerometers judicially distributed so as to determine the vibrations to which it is adapterjected during a drilling operation. In this known drillbit, the accelerometers are positioned in the drilling head, which means that the acquisition of the parameters is only possible for this particular drilling head thus equipped.

Document U.S. Pat. No. 4,303,994 describes a drilling installation comprising a drillbit, a drill string and measurement gauges that are housed in the drill string. In that document, the measurement gauges are placed in the upper portion of the drill string, but information about the way in which they are inserted into the drill string is not provided. The arrangement of the measurement gauges in the upper portion of the drill string constitutes a disadvantage, as the measurements that they make do not take into account the local deformations undergone by the lower portion of the drill string between the measurement gauges and the drillbit. These deformations comprise especially bending and twisting, the characteristics of which vary over the course of time as the drilling progresses. It follows that there is sometimes considerable discrepancy between the measurements recorded by the gauges and the actual operating characteristics of the drillbit and its cutting head. Furthermore, the assembly of measurement gauges is relatively long, so that it is normally impossible to position it between the drillbit and a downhole motor.

Moreover, the known measurement equipment described in the aforementioned documents is generally not standard equipment, but has to be adapted, in each case, to the drillbit or drill string used. This complicates the construction of these devices, represents an obstacle to mass production, and increases their cost.

SUMMARY OF THE INVENTION

One objective of the invention is to remedy the drawbacks and disadvantages of the known measurement devices described above.

More particularly, the objective of the invention is to provide an autonomous measurement device that can be easily separated from the drilling installation and recovered, should it be damaged.

Another objective of the invention is to provide a measurement device that can be positioned in a drilling installation so as to avoid any discrepancy between the measurements made and the instantaneous characteristics of the drillbit and its drilling head.

An additional objective of the invention consists in providing a measurement device of standard construction, which consequently can be mass-produced and therefore is of moderate cost.

It is also an object of the invention to provide a measurement device that is sufficiently compact to be able to be placed in the immediate vicinity of the drillbit (or its cutting head), between the bit and a downhole motor.

Consequently, the invention relates to a device comprising equipment for measuring for monitoring a drilling or coring operation by means of a drillbit fixed to the end of a drill string, the device is characterized in that the measurement equipment is housed in at least one chamber made in a coupling that is designed to be interposed between two drill string pipes or between the drillbit and a drill string pipe.

In the installation according to the invention, the drillbit is not critical and it may be any known drillbit commonly used for coring or drilling of mine shafts, oil wells, gas wells or artesian wells. The drillbit normally comprises, in the usual manner, a cutting head and, fastened to the cutting head, an adapter. The adapter is intended to fasten the drillbit to the end of a drill string.

By definition, the cuffing head comprises the cutting bits intended to attack the rock of the well during drilling. The cutting bits are not critical for the invention and may comprise stationary bits or roller cone bits or they may comprise stationary bits and roller cone bits. Examples of stationary bits are those known in drilling technology by the names PDC (polycrystalline diamond compact) bits, TSD (thermally stable synthetic diamond) bits and "impregnated" bits.

The adapter carries the cutting head and comprises a coupler for removable coupling to a drill string. The coupler is advantageously standardized, for example according to the API (American Petroleum Institute) standard, although this is not essential in respect of the definition of the invention.

The drill string serves as mechanical connection between the drillbit, located at the bottom of the hole, and a motor. The latter may be a downhole motor or a motor located on the surface. The drill string is normally formed from an assembly of drill pipes. The pipes are normally assembled one after another as the drillbit advances into the hole during drilling. It may be vertical, oblique, horizontal or bent, or it may have any profile matched to that of the drillhole to be drilled. To join the pipes together, they are provided with couplers that are generally standardized. These couplers usually have threaded end-fittings, which are screwed into corresponding tapped end-fittings. They are advantageously according to the API (American Petroleum Institute) standard.

The measurement equipment is used to record and measure drilling parameters, such as the instantaneous rotation speed of the drillbit and its speed variations over the course of time, the position of the drillbit in the hole, the mechanical forces to which it is adapterjected in the hole, especially the magnitude and the direction of the axial and lateral stresses on contact with the wall of the well, and the electrical conductivity of the drilling mud (this list being exemplary but not exhaustive). The measurement equipment is not critical in respect of the definition of the invention and may comprise accelerometers, magnetometers, thermometers, pressure gauges, electrical resistance measurement electrodes, strain gauges or any other measurement gauge for measuring physical or chemical quantities commonly used in measuring equipment for well coring or drilling installations. Additional information about the measurement equipment that can be used in the device according to the invention may be obtained in particular from documents BE-1 007 274 and EP 0 377 235. The measurement equipment may include an autonomous recording device. As a variant, it may be connected to a recording and analysis device located on the surface.

By definition, for the purpose of the present invention the expression "measurement equipment" includes the power supply circuit for the measurement gauges of said measurement equipment. This power supply may comprise one or more electric cells or one or more electric storage batteries, and also electronic components normally required for the operation of the measurement gauges.

According to the invention, the measurement equipment is housed in at least one chamber made in a coupling and is designed to be interposed between two drill string pipes or between the drillbit and a drill string pipe.

The coupling is a mechanical connecting part, which is designed to ensure mechanical connection between two drill string pipes or between a drill string pipe and the drillbit. Consequently, it is equipped with a coupler for coupling it to the drill string. Details about this coupler will be given later.

The coupling may have any shape compatible with its insertion into the drill string or between the latter and the drillbit. Its dimensions must of course be compatible with its passage along the well, without compromising the drilling and the advance of the drillbit into the well. It is preferably cylindrical and is preferably pierced with an axial duct for circulation of a drilling fluid, especially a drilling mud.

The chamber made in the coupler must have dimensions sufficient to accommodate the measurement equipment. This may be a single chamber or two or more chambers. The coupling and the chamber(s) are advantageously shaped so as to prevent the formation of an imbalance when the coupling, loaded with the measurement equipment, is incorporated into the drill string.

The (or each) chamber in the coupling opens normally to the periphery of the coupling in order to allow the measurement equipment to be housed therein. The (or each) chamber may be closed off by any suitable means capable of providing a hermetic seal and of withstanding the pressure of the drilling mud. This means may be a non-detachable means and comprise a panel welded or bonded to the coupling. Preferably, according to the invention, this is a detachable closure means.

In one advantageous embodiment of the device according to the invention, the coupling is cylindrical and the chamber is formed in a groove that is made on the periphery of the cylindrical coupling. In the case of a single chamber, the groove is preferably annular. If the coupling has several chambers, these may advantageously be formed in grooves that are uniformly distributed around the periphery of the coupling.

In the advantageous embodiment that has just been described, the groove or grooves may be closed off by any suitable known means. Preferably, according to the invention, a sheath placed around the coupling is used. In this advantageous embodiment of the invention, the sheath and its method of attachment to the coupling must be designed to withstand the pressure of the drilling mud.

The device according to the invention, in the embodiment described above, has the beneficial feature of being compact and of small volume, owing to the fact that all of the measurement equipment is housed in a single groove or in a limited number of grooves, on the periphery of the coupling. This compactness allows the device to be placed in the immediate vicinity of the drillbit, ideally between the latter and a downhole motor.

In one particular embodiment of the device according to the invention, components of the measurement equipment are superposed in the groove, in a direction transverse to the axis of symmetry of the coupling. More generally, in this particular embodiment of the invention, the measurement equipment comprises at least two components that are superposed in the or each groove.

In the present specification, the term "superposed" is considered in a radial direction of the coupling and of the groove. Among the two superposed components, the one furthest away from the rotation axis of the coupling is, by definition, on top of the other component.

In a preferred embodiment of the invention, the two components of the measurement equipment advantageously comprise at least one strain gauge, which is placed in the bottom of the groove, and an electronic circuit placed above the strain gauge. In this preferred embodiment of the invention, the strain gauge is a measurement gauge designed to measure a mechanical stress generated by a tensile, compressive, bending or twisting force to which the coupling is adapterjected during its normal use in a drilling or coring installation. Such measurement gauges are well known in the art. Hereafter, for the sake of simplicity, the expression "strain gauge" will be used to denote a gauge for measuring a mechanical stress.

In the preferred embodiment that has just been described, it is advantageous to house the strain gauge in a gutter provided in the bottom of the groove. The groove and the gutter are preferably annular.

In the preferred embodiment that has just been described, it is advantageous for the component placed on top of the strain gauge to comprise an electrical generator, in addition to the electronic circuit. In this embodiment of the invention, the electrical generator may for example comprise a set of cells, which are held captive in a removable module. The cells may be mounted removably in the module or embedded in a block of resin.

In an especially recommended variant of the preferred embodiment described above, the electronic circuit is placed on a bracket that straddles the strain gauge. This variant of the invention facilitates construction of the device and optimum positioning of the measurement equipment in the groove.

In the device according to the invention, it is necessary to take care to ensure that the arrangement of the various constituents of the measurement equipment in the coupling and the way they are fastened do not impair the precision of the measurements made by the strain gauge.

For this purpose, when a bracket is used to support the electronic circuit, as explained above, it is recommended that the fastening of the bracket to the coupling be designed so as not to impede free deformation of the coupling under the effect of an axial tensile force and/or an axial compressive force and/or a bending force and/or a twisting force. As a variant, a similar result may be obtained by using a low-stiffness material for the bracket.

In the device according to the invention, the measurement equipment may advantageously include, in addition to the strain gauge, additional measurement gauges selected from accelerometers, magnetometers, thermometers, manometers and electrical resistance measurement electrodes.

As explained above, the coupling is designed to be inserted either between two drill string pipes and to ensure their connection, or between a drill pipe and the drillbit and therefore to ensure their connection. The coupling is consequently provided with couplers designed to make these connections. These couplers may advantageously be of the type of those described above for joining the drill string pipes together and comprise a threaded end and a tapped end. Advantageously, they may be standardized, for example in accordance with the API (American Petroleum Institute) standard. In this embodiment of the invention, the threaded end of the coupling is intended to be screwed into a corresponding tapped end of one drill string pipe and its tapped end is intended to be screwed onto the corresponding threaded end of another drill string pipe or onto the threaded end of the adapter of the drillbit. In this embodiment of the invention, the coupling (and the measurement equipment that it contains) may be placed as required at any point along the drill string. It is advantageous to place it in the immediate vicinity of the drillbit, so as to prevent the measurements made by the measurement equipment being disturbed by any local deformation of the drill string. This embodiment of the invention has however the advantageous feature of enabling additional measurement equipment to be inserted at any time into the drill string, for example for carrying out additional measurements or for making up for an occasional deficiency in any downhole measurement equipment during drilling. Owing to its very small volume, the device according to the invention now allows measurement equipment to be located in the immediate vicinity of the cutting head of the drillbit and of the cutting face, ideally between the drillbit and a downhole motor or any other drilling device for directional drilling, such as recent rotary steering systems.

The device according to the invention constitutes a standard part for the insertion of measurement equipment as required into well-drilling installations, at any appropriate point in the immediate vicinity of the drillbit, or into the drill string. It may be mounted as a single example or as several examples in the drill string and may also be recovered, together with its measurement equipment, so as to be used adaptersequently in another drilling installation.

In one particularly advantageous embodiment of the device according to the invention, the coupling is designed to be fastened directly and removably to the cutting head of the drillbit. In this embodiment of the invention, the coupling constitutes the adapter for joining the drillbit to the drill string. One end of the coupling comprises a removable fastening member for fastening to the cutting head of the drillbit and its other end comprises a standard coupler for coupling to a drill string. The member for fastening to the cutting head must be designed to ensure a rigid connection. For this purpose, the coupling may advantageously be bolted to the cutting head. The member for coupling to the drill string normally comprises, in the usual manner, a threaded end-fitting intended to be screwed into a corresponding tapped end-fitting of a drill string pipe. Advantageously, it is standardized, for example in accordance with the API (American Petroleum Institute) standard.

In the embodiment that has just been described, the use of bolts or screws for fastening the coupling to the cutting head has the advantage of making the fitting and removal operations easier, these not requiring a special tool and consequently enabling them to be carried out directly on a work site. For comparison, an assembly in which the coupling is to be screwed into the cutting head would imply high tightening torques, requiring specialized machines.

The embodiment that has just been described has the advantage that the measurement equipment is located in the drillbit, in the immediate vicinity of the cutting head and of the drilling face of the well. This results, all other things being equal, in optimum reliability of the measurements made, these not being disturbed by local deformations undergone by the drill string.

In the particularly advantageous embodiment that has just been described, the coupling of the device according to the invention forms an integral part of the drillbit.

The invention therefore also relates to a drillbit comprising, conventionally, a cutting head and a threaded adapter for joining it to a drill string, in which the threaded adapter is a coupling according to the invention.

The invention also relates to a drilling and/or coring installation, comprising a drillbit and a drill string, the installation being characterized in that it incorporates a device according to the invention.

In the installation according to the invention, the device may be placed between two drill string pipes or between a pipe and an adapter of a drillbit cutting head. Although this is not absolutely essential for implementing the invention, it is preferable for the device to be placed in the immediate vicinity of the drillbit.

In a preferred embodiment of the installation according to the invention, the drillbit that equips it is a drillbit according to the invention in which the device constitutes the adapter for joining the cutting head to the drill string.

BRIEF DESCRIPTION OF THE DRAWINGS

Features and details of the invention will become apparent over the course of the following description of the appended drawings, which show a few particular embodiments of the invention.

In the figures, identical reference numbers denote the same elements.

DETAILED DESCRIPTION OF PARTICULAR EMBODIMENTS

Figure 1:
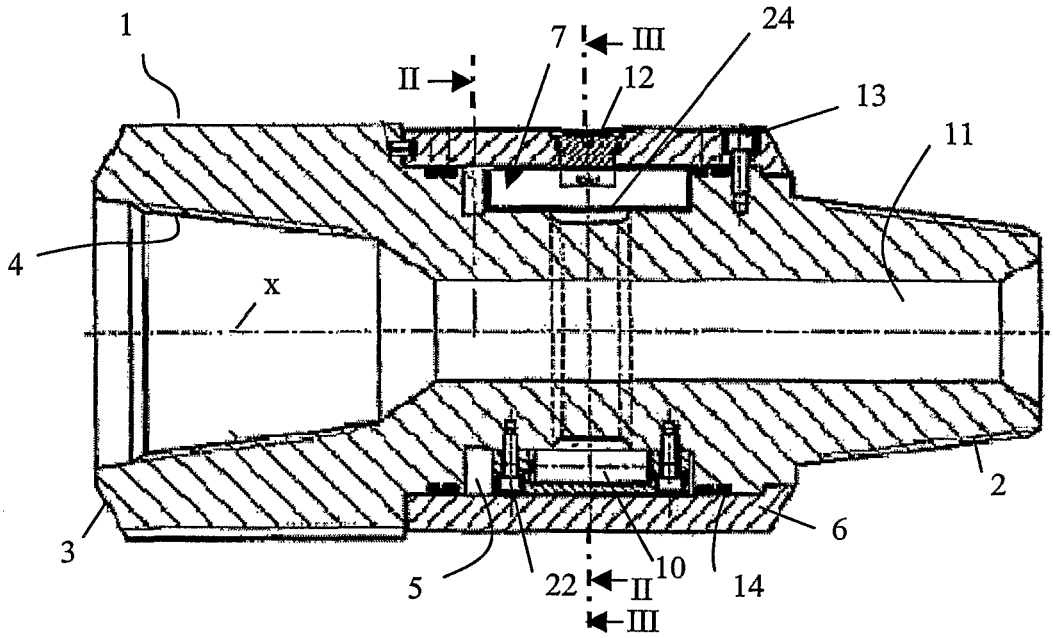
FIG. 1 shows one particular embodiment of the device according to the invention, in axial section.

The device according to the invention, shown in FIGS. 1 to 5, comprises a coupling 1 adapterstantially axisymmetric about a linear axis X. One end 2 of the coupling 1 is frustoconical and threaded, while the other end 3 has a tapped frustoconical opening 4. The threaded end 2 is designed to be screwed into a corresponding tapped opening of a drill string pipe (not shown) of a drilling or coring installation. The tapped opening 4 is designed to be screwed onto a corresponding threaded end of another drill string pipe or onto the threaded end of the adapter of a drillbit (not shown). The threaded end-fittings 2 and the tapped end-fittings 4 are in accordance with the API (American Petroleum Institute) standard.

Figure 2:
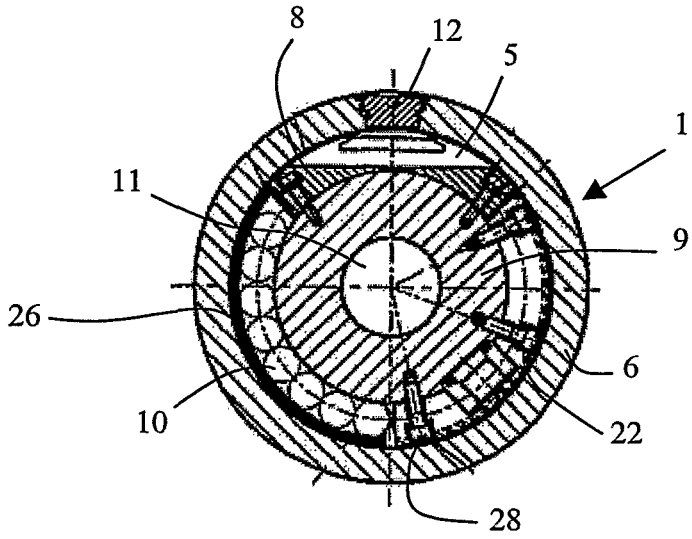
FIG. 2 is a section on the plane II-II of FIG. 1.
Figure 3:
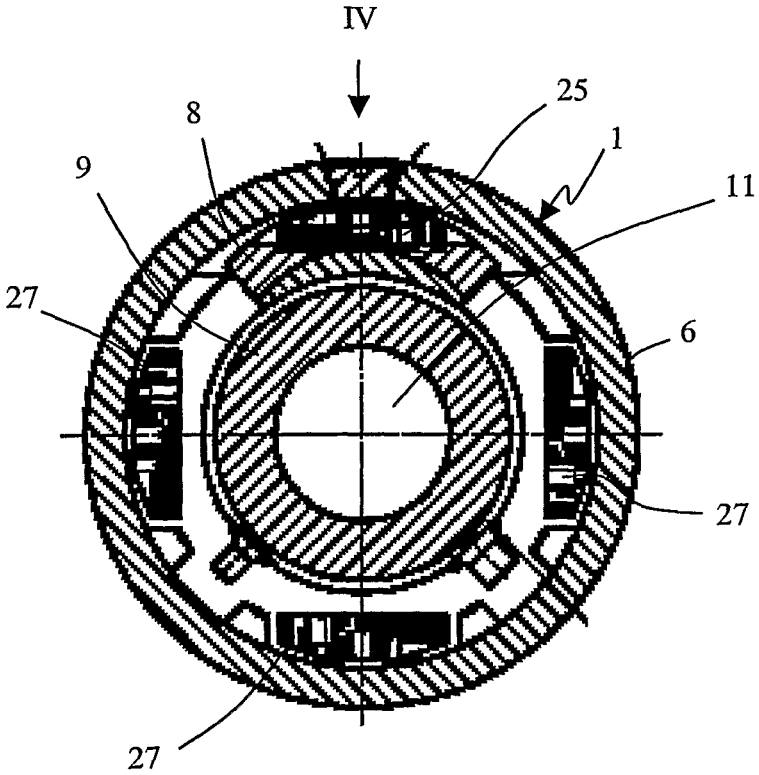
FIG. 3 is a section on the plane III-III of FIG. 1.
Figure 4:
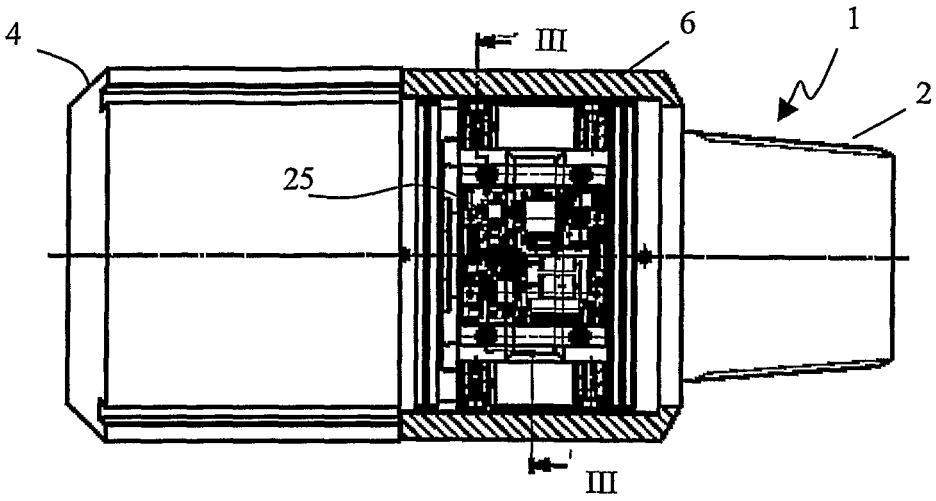
FIG. 4 shows the device of FIGS. 1 to 3, in the direction of the arrow IV of FIG. 3.
Figure 5:
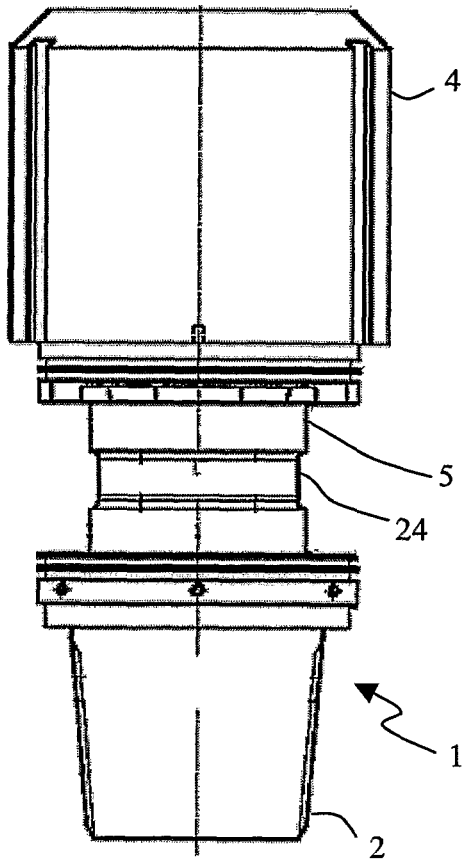
FIG. 5 is a side view of the device of FIGS. 1 to 4.

Between its ends 2 and 3, the coupling has an annular groove 5 forming a chamber that may be closed off by means of a cylindrical sheath 6. An annular gutter 24 is provided in the bottom of the groove 5. The annular groove 5 contains measurement equipment denoted, in its entirety, by the reference number 7. The measurement equipment 7 comprises strain gauges (not shown) that are placed in the gutter 24, around the cylindrical axial core 9 of the coupling. Ideally, two or three strain gauges are placed in the gutter 24, in orthogonal positions. The strain gauges are connected, via electrical connectors, to an electronic circuit 25 (a printed circuit) placed on a bracket 8 fastened to the axial core 9 of the coupling 1 by means of bolts 22. The bracket 8 is made of aluminium, so that its stiffness is low enough to not prevent the coupling 1 from deforming freely during a normal drilling or coring operation. The power supply for the electronic circuit 25 is provided by a set of cells 10. These are housed in an annular module 26, which is inserted into the annular groove 5, along the extension of the bracket 8. The annular module 26 is bolted to the axial core 9 of the coupling by a series of bolts 28 (FIG. 2).

The measurement equipment 7 further includes additional measurement gauges (not shown) that are placed on the bracket 8 or in the groove 5, and also satellite electronic cards 27 placed in the groove 5. The additional measurement gauges are designed to record operating parameters of a drilling or coring operation and may for example comprise, as is usual, an accelerometer, a magnetometer, a thermometer, a pressure gauge and an electrical resistance measurement electrode (this list is not exhaustive). The electronic circuits 25 and 27 are used for recording and for processing the physical and, as the case may be, chemical quantities measured by the strain gauges (located in the gutter 24) and the additional measurement gauges. They may also include a regulating member (not shown) for automatically starting the gauges or for automatically placing them in standby mode. This regulating member, well known in the art, normally comprises a clock and a detector for detecting the movement of the drillbit, which is programmed to record the state of movement or state of stress of the drillbit at predefined time intervals (for example its rotation speed or a torque) and to set the gauges in standby mode while the drillbit is at rest or to actuate them if the drillbit is moving or under stress.

The sheath 6 is made of high-strength steel so as to be able to withstand the pressure of the drilling mud during a normal drilling or coring operation. It is fastened to the body of the coupling 1 by means of bolts 13. O-rings 14 seal the chamber 5. The fastening of the sheath 6 by means of the bolts 13 is designed so as to give the sheath a sufficient degree of freedom so that it does not impede with free deformation of the coupling 1 during a normal drilling or coring operation.

A removable hermetic seal 12 gives access to the electronic circuit 25 in the annular groove 5.

The internal core 9 is pierced by an axial duct 11 which lies along the extension of the ends or end-fittings 2 and 3 of the coupling 1. When the coupling 1 is fitted into a drill string of a drilling or coring installation, its axial duct 11 lies along the extension of the corresponding ducts of the drill string and therefore serves for the circulation of a drilling or coring fluid.

The coupling 1 is intended to be inserted between two drill string pipes of a drilling or coring installation or between the drillbit and the first drill string pipe. For this purpose, the threaded end-fitting 2 of the coupling is screwed into a corresponding tapped end-fitting of a drill string pipe and its tapped end-fitting 3 is screwed onto the threaded end-fitting of the drillbit or of another drill string pipe.

Figure 6:
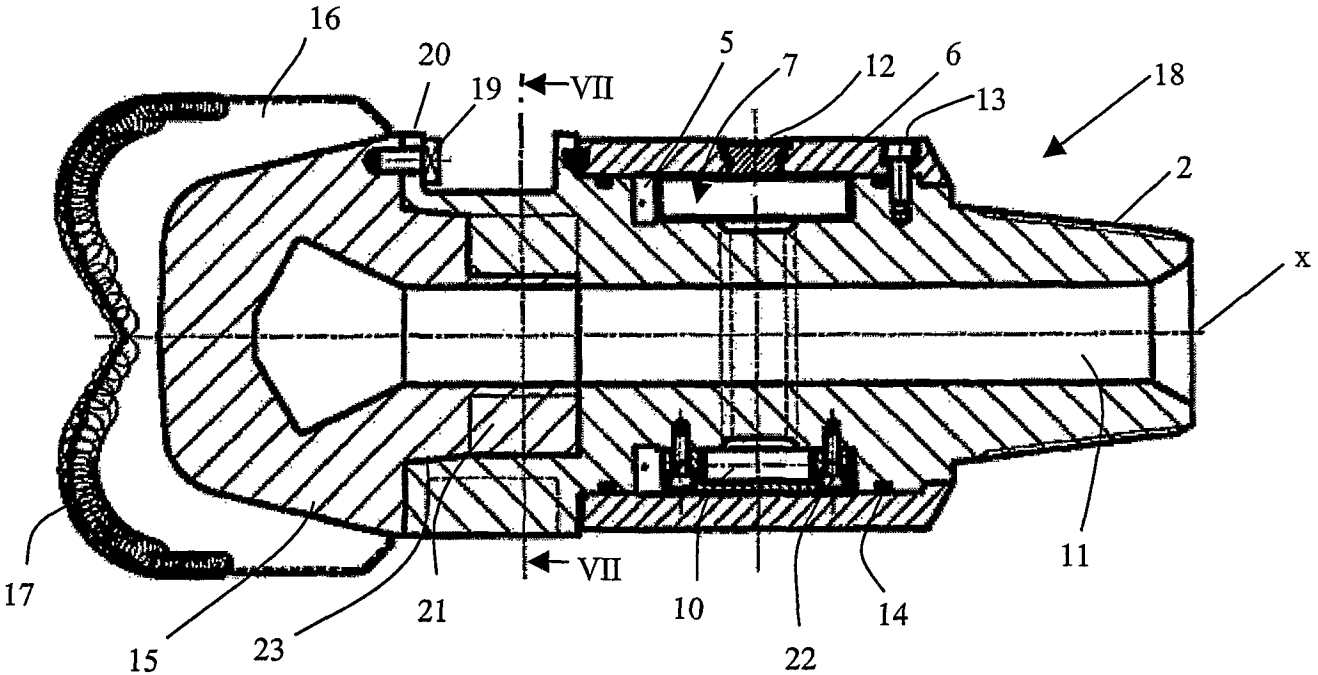
FIG. 6 shows one embodiment of the drillbit according to the invention, in axial longitudinal section.
Figure 7:
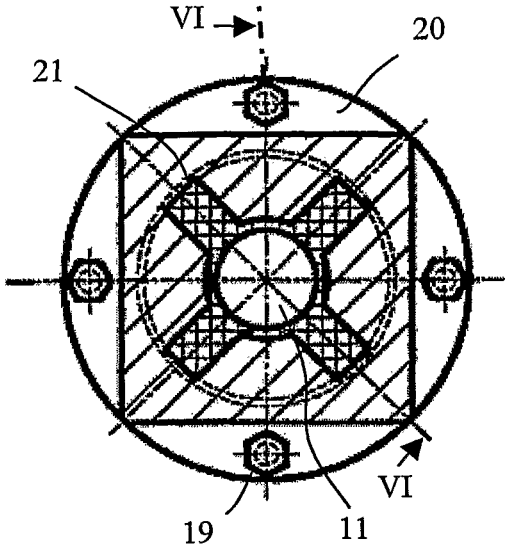
FIG. 7 is a section on the plane VII-VII of FIG. 6.

The drillbit according to the invention, shown in FIGS. 6 and 7, comprises a cutting head 15 provided with longitudinal blades 16 carrying cutting bits 17. Cutting heads of this type are well known in oil well drilling techniques.

The cutting head 15 is fastened to an adapter 18 by means of a ring of bolts 19 that passes through an annular flange 20 of the adapter 18. An assembly of channels and ribs 21 reinforces the fastening of the cutting head 15 to the adapter 18 and a frustoconical joint 23 increases the flexural strength of the assembly.

The adapter 18 is provided, at its rear end, with a threaded frustoconical end-fitting 2 intended to be inserted and screwed into a corresponding tapped end-fitting of a drill string pipe. The adapter 18 is of a similar design to the coupling 1 described in FIGS. 1 to 3 and itself includes an annular chamber 5, hermetically sealed by a sheath 6 and intended to contain equipment 7 for measuring operating parameters of a drilling or coring operation. In respect of this measurement equipment 7, what was stated above in respect of the measurement equipment 7 of the device shown in FIGS. 1 to 5 may be repeated.

Figure 8:
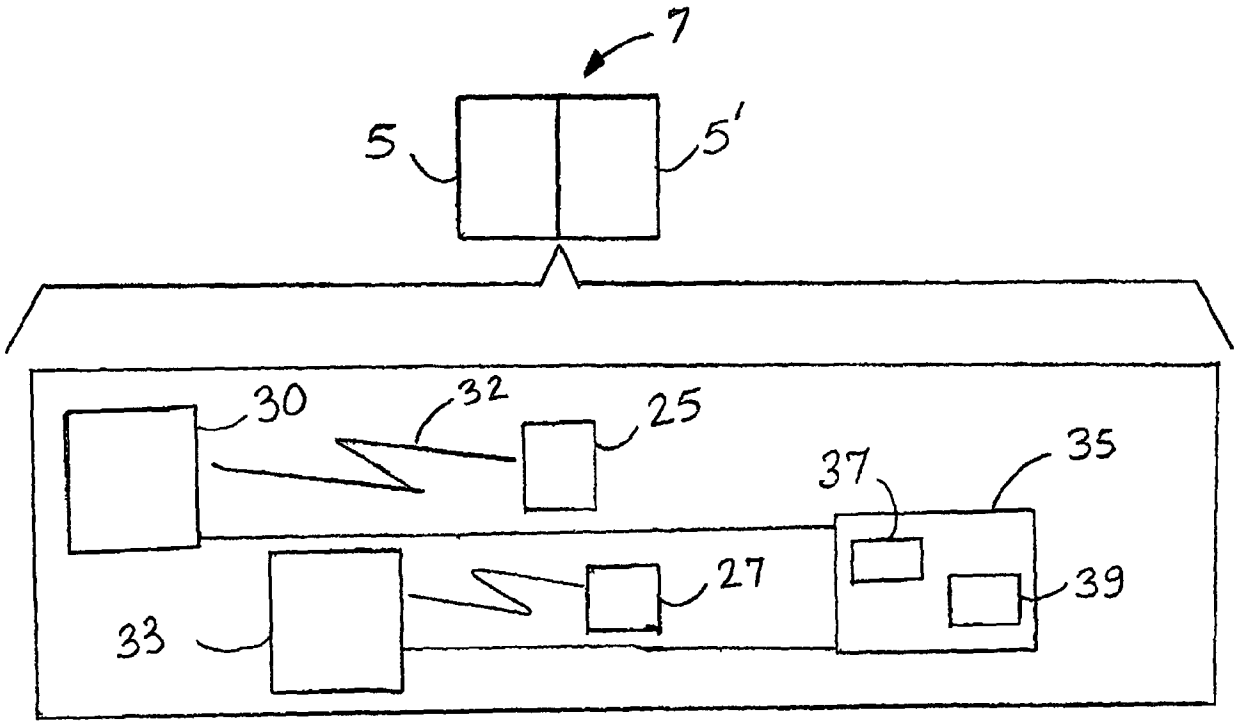
FIG. 8 is a block diagram of the measurement device.

FIG. 8 is a block diagram showing the measurement equipment 7 comprising one or more chambers 5, 5', having one or more strain gauges 30 connected via electrical connectors 32 to an electronic circuit 25. Additional measurement gauges 33 are connected to an electronic circuit 27 and record parameters of a drilling or coring operation as previously described. A regulating member 35, which may comprise a clock 37 and a detector 39, may also be included for automatically starting the gauges or for automatically placing them in standby mode. The regulating member 35 functions as described previously.

The invention claimed is:

1. A device comprising autonomous passive downhole measurement equipment for autonomously measuring, monitoring and storing for subsequent analysis parameters of a drilling or coring operation by means of a drillbit fixed to an end of a drill string, comprising a coupling co-axially and removably interposed between two drill string pipes or between the drillbit and a drill string pipe, wherein the measurement equipment is compact and is housed in at least one compact chamber in the coupling, wherein the coupling is cylindrical and the or each chamber includes a groove made on the periphery of the coupling, and wherein the measurement equipment includes at least two measurement components radially superposed in the or each groove in a direction transverse to the axis of symmetry of the coupling, wherein the two components comprise at least one strain gauge, and an electronic circuit placed radially above the strain gauge, and wherein the electronic circuit includes a regulating member for automatically starting up the measurement equipment or for automatically putting it on standby.

2. A device according to claim 1, wherein the or each groove is annular.

3. A device according to claim 1, wherein the coupling includes at least two chambers having the grooves that are placed uniformly on the periphery of the coupling.

4. A device according to claim 1, wherein the coupling is engaged in a sheath that closes off the or each groove.

5. A device according to claim 1, wherein the two components comprising at least one strain gauge is placed in the bottom of the groove.

6. A device according to claim 1, wherein the strain gauge is housed in a gutter provided in the bottom of the groove.

7. A device according to claim 6, wherein the or each groove is annular and the gutter is annular.

8. A device according to claim 1, wherein the component placed above the strain gauge comprises an electrical generator.

9. A device according to claim 8, wherein the electrical generator comprises a set of cells that are housed in a removable module.

10. A device according to claim 1, wherein the electronic circuit is placed on a bracket that straddles the strain gauge.

11. A device according to claim 10, wherein the mounting of the bracket to the coupling is designed to allow the coupling to deform freely under the effect of an axial tensile force and/or an axial compressive force and/or a bending force and/or a twisting force.

12. A device according to claim 10 wherein the bracket is made of a low-stiffness material.

13. A device according to claim 1, wherein the coupling is engaged in a sheath that closes off the or each groove, the mounting of said sheath to the coupling is designed to allow the coupling to deform freely under the effect of forces selected from the group consisting of an axial tensile force, an axial compressive force, a bending force, a twisting force, and combinations thereof.

14. A device according to claim 1, wherein the measurement equipment includes, in addition to the strain gauge, additional measurement gauges selected from the group consisting of accelerometers, magnetometers, thermometers, pressure gauges and resistance measurement electrodes.

15. A device according to claim 1, wherein the regulating member comprises a clock and a drillbit movement detector, which is programmed to record the state of movement or stress of the drillbit at predefined time intervals and to place the measurement in standby mode while the drillbit is at rest or to actuate it if the drillbit is moving and under stress.

16. A device according to claim 15, wherein the aforementioned state of movement or stress comprises the rotation speed of the drillbit and/or a torque.

17. A device according to claim 1, wherein the coupling is designed to removably fasten to a cutting head of the drillbit.

18. A device according to claim 17, wherein the coupling has a threaded end for fastening it to a drill string pipe and is bolted at its other end to the cutting head.

19. A drillbit comprising a cutting head fastened to a threaded adapter for joining it to a drill string, wherein the adapter includes the coupling according to claim 17.

20. A drilling and/or coring installation, comprising a drillbit and a drill string, wherein the drillbit is according to claim 19.

21. A device according to claim 1, wherein the coupling has a threaded end for fastening it to a drill string pipe and a tapped end for fastening it to another drill string pipe or to an adapter on the drillbit.

22. A drilling and/or coring installation, comprising a drillbit and a drill string, wherein it incorporates the device according to claim 21.

23. A device comprising autonomous passive downhole measurement equipment for autonomously measuring, monitoring and storing for subsequent analysis parameters of a drilling or coring operation by means of a drillbit fixed to an end of a drill string, comprising a coupling co-axially and removably interposed between two drill string pipes or between the drillbit and a drill string pipe, wherein the measurement equipment is compact and is housed in at least one compact chamber in the coupling, wherein the coupling is cylindrical and the or each chamber includes a groove made on the periphery of the coupling, and wherein the measurement equipment includes at least two measurement components radially superposed in the or each groove in a direction transverse to the axis of symmetry of the coupling, wherein the at least one chamber and the or each groove are annular and further comprising an annular sleeve to close off the groove and the superposed components of the measuring equipment.

24. A device according to claim 23 further comprising an outer annular recess extending from one end of the coupling beyond the annular groove and o-rings between the recess and the sleeve for sealing the groove within the sleeve.

25. A device comprising autonomous monitoring equipment for measuring and storing, for subsequent analysis, downhole parameters of a drilling or coring operation by means of a drillbit fixed to the end of a drill string, wherein the measurement equipment is housed in at least one chamber made in a coupling that is designed to be interposed between the drillbit and a first, in use lowermost, drill string pipe such that the coupling is located in the immediate vicinity of the drillbit, wherein the coupling is cylindrical and the chamber includes an annular groove made on the periphery of the coupling, wherein the measurement equipment includes at least two measurement components that are radially superposed in the groove in a direction transverse to the axis (X) of symmetry of the coupling such that one of the at least two components is further away from the rotation axis (X) of the coupling and is on top of the other one of the at least two components, and wherein the coupling is engaged in a sheath that closes off the or each groove, the fastening of the sheath to the coupling is designed to allow the coupling to deform freely under the effect of an axial tensile force and/or an axial compressive force and/or a bending force and/or a twisting force.

26. The device according to claim 25, wherein the coupling includes at least two chambers, and wherein these chambers have two grooves that are placed uniformly on the periphery of the coupling.

27. The device according to claim 25, wherein the coupling is engaged in a sheath that closes off the or each groove.

28. The device according to claim 25, wherein the other one of the at least two components comprises at least one strain gauge, which is place in the bottom of the groove, and the one of the at least two components comprises an electronic circuit placed above the strain gauge.

29. The device according to claim 28, wherein the strain gauge is housed in a gutter provided in the bottom of the groove.

30. The device according to claim 29, wherein the gutter is annular.

31. The device according to claim 28, wherein the component placed above the strain gauge comprises an electrical generator.

32. The device according to claim 31, wherein the electrical generator comprises a set of cells that are housed in a removable module.

33. The device according to claim 28, wherein the measurement equipment includes, in addition to the strain gauge, additional measurement gauges selected from accelerometers, magnetometers, thermometers, pressure gauges and resistance measurement electrodes.

34. The device according to claim 28, wherein the electronic circuit includes a regulating member for automatically starting up the measurement equipment or for automatically putting it on standby.

35. The device according to claim 34, wherein the regulating member comprises a clock and a drillbit movement detector, which is programmed to record the state of movement or stress of the drillbit at predefined time intervals and to place the measurement in standby mode while the drillbit is at rest or to actuate it if the drillbit is moving and under stress.

36. The device according to claim 25, wherein the aforementioned state of movement or stress comprises the rotation speed of the drillbit and/or a torque.

37. The device according to claim 25, wherein the coupling is designed to removably fasten to a cutting head of the drillbit.

38. The device according to claim 37, wherein the coupling has a threaded end for fastening it to a drill string pipe and is bolted at its other end to the cutting head.

39. The device according to claim 37, wherein the cutting head of the drillbit is fastened to a threaded adapter for joining it to a drill string, and wherein the adapter includes a coupling.

40. The device according to claim 39, wherein a drilling and/or coring installation is comprised of the drillbit and the drill string.

41. The device according to claim 25, wherein the coupling has a threaded end for fastening it to a drill string pipe and a tapped end for fastening it to an adapter on the drillbit.

42. The device according to claim 41, further comprising a drilling or coring installation comprised of a drillbit and a drill string.

43. A device comprising autonomous monitoring equipment for measuring and storing, for subsequent analysis, downhole parameters of a drilling or coring operation by means of a drillbit fixed to the end of a drill string, wherein the measurement equipment is housed in at least one chamber made in a coupling that is designed to be interposed between the drillbit and a first, in use lowermost, drill string pipe such that the coupling is located in the immediate vicinity of the drillbit, wherein the coupling is cylindrical and the chamber includes an annular groove made on the periphery of the coupling, wherein the measurement equipment includes at least two measurement components that are radially superposed in the groove in a direction transverse to the axis (X) of symmetry of the coupling such that one of the at least two components is further away from the rotation axis (X) of the coupling and is on top of the other one of the at least two components, wherein the other one of the at least two components comprises at least one strain gauge, which is place in the bottom of the groove, and the one of the at least two components comprises an electronic circuit placed above the strain gauge, and wherein the electronic circuit is placed on a bracket that straddles the strain gauge.

44. The device according to claim 43, wherein the fastening of the bracket to the coupling is designed to allow the coupling to deform freely under the effect of an axial tensile force and/or an axial compressive force and/or a bending force and/or a twisting force.

45. The device according to claim 43, wherein the bracket is made of a low-stiffness material.

46. A device comprising autonomous passive downhole measurement equipment for autonomously measuring, monitoring and storing for subsequent analysis parameters of a drilling or coring operation by means of a drillbit fixed to an end of a drill string, comprising a coupling co-axially and removably interposed between two drill string pipes or between the drillbit and a drill string pipe, wherein the measurement equipment is compact and is housed in at least one compact chamber in the coupling, wherein the coupling is cylindrical and the or each chamber includes a groove made on the periphery of the coupling, and wherein the measurement equipment includes at least two measurement components radially superposed in the or each groove in a direction transverse to the axis of symmetry of the coupling, and wherein the coupling is engaged in a sheath that closes off the or each groove, the fastening of the sheath to the coupling is designed to allow the coupling to deform freely under the effect of an axial tensile force and/or an axial compressive force and/or a bending force and/or a twisting force.

* * * * *